United States Patent [19]

Sasahara

[11] 3,942,345

[45] Mar. 9, 1976

[54] KEY OPERATED MAGNETIC TUMBLER LOCK

[75] Inventor: Takashi Sasahara, Tokyo, Japan

[73] Assignee: Japan Magnetic Lock Co., Ltd., Kawasaki, Japan

[22] Filed: Nov. 4, 1974

[21] Appl. No.: 520,295

[30] Foreign Application Priority Data

Nov. 24, 1973 Japan ..... 48-131187

[52] U.S. Cl. ..... 70/276; 70/358

[51] Int. Cl.[2] ..... E05B 47/00; E05B 27/00

[58] Field of Search ..... 70/276, 358, 413

[56] References Cited

UNITED STATES PATENTS

| | | | |
|---|---|---|---|
| 2,079,628 | 5/1937 | Olson | 70/364 R |
| 3,566,637 | 3/1971 | Hallmann | 70/276 |
| 3,657,907 | 4/1972 | Boving | 70/38 C |

FOREIGN PATENTS OR APPLICATIONS

| | | | |
|---|---|---|---|
| 1,036,702 | 8/1958 | Germany | 70/413 |

*Primary Examiner*—Albert G. Craig, Jr.
*Attorney, Agent, or Firm*—Christensen, O'Connor, Garrison & Havelka

[57] ABSTRACT

A key operated locking device of the type using a coded magnetic key to operate a plurality of correspondingly coded magnetic tumblers. The device serves to selectively lock and unlock relative rotation between inner and outer coaxial cylinders in which the inner cylinder has a keyway disposed therein for receiving the magnetically coded key and also carries a plurality of spring-biased magnetic tumblers which magnetically interact with the key. The outer cylinder is provided with a plurality of detents cooperating with the magnetic tumblers wherein the tumblers are normally spring-biased into engagement with the detents of the outer cylinder and are unlocked therefrom by inserting a properly coded magnetic key into the inner cylinder keyway to withdraw in concert the tumblers from the detents by magnetic attraction. With the key in place the inner cylinder may then be rotated relative to the outer cylinder, while the magnetic attraction continuously maintains the tumblers in a recessed or condition inside the inner cylinder.

9 Claims, 7 Drawing Figures

Fig. 3
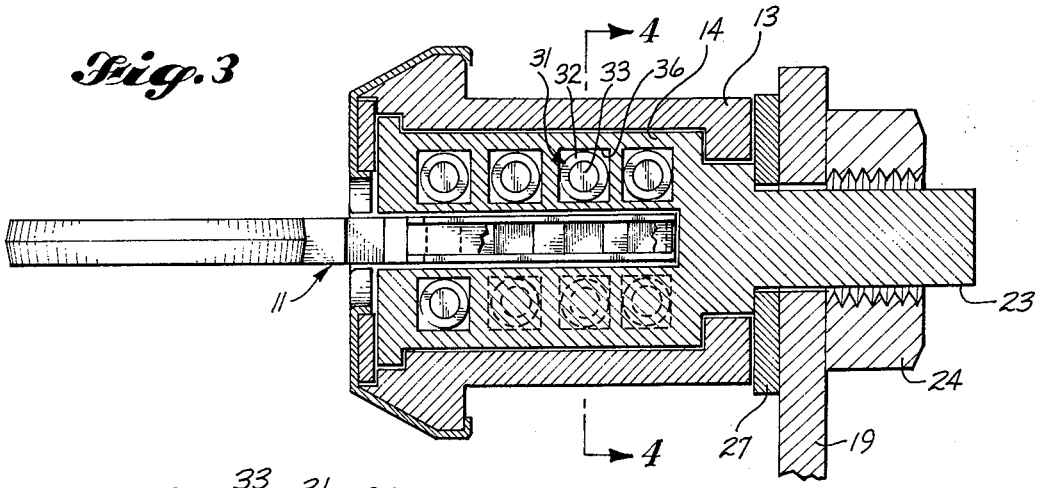
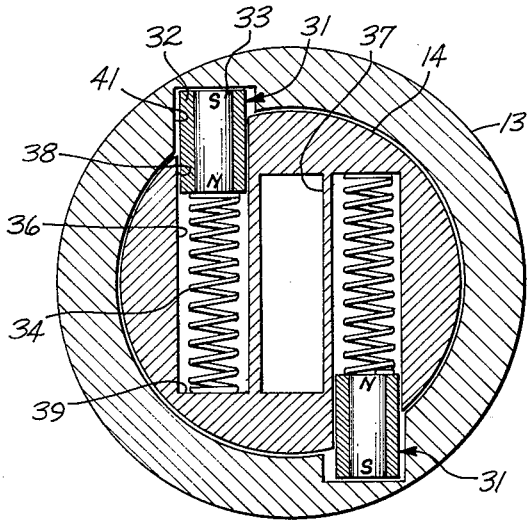
Fig. 4
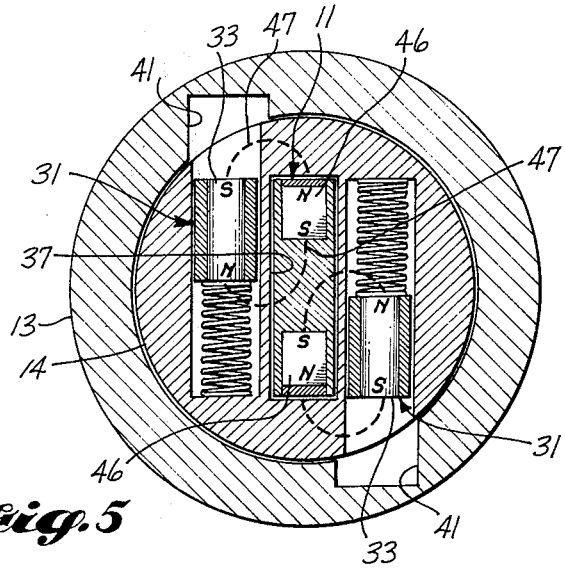
Fig. 5
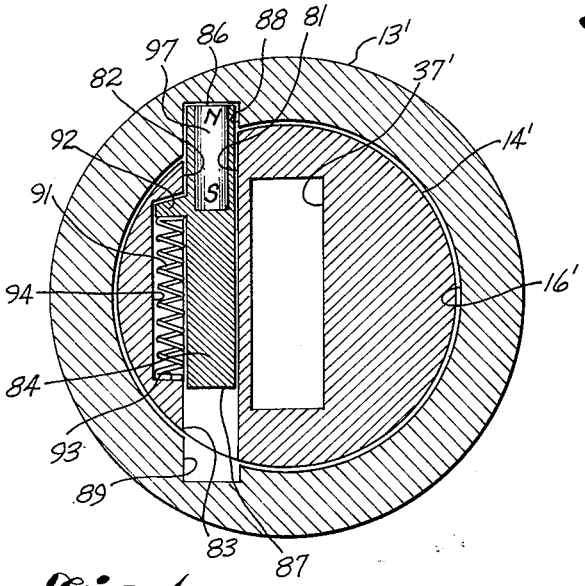
Fig. 6
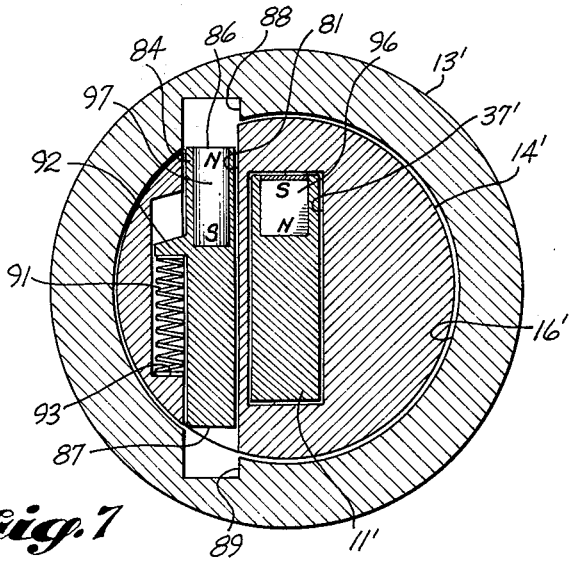
Fig. 7

KEY OPERATED MAGNETIC TUMBLER LOCK

BACKGROUND OF THE INVENTION

This invention relates in general to magnetic tumbler locks of the type using a coded magnetic key to operate in concert a plurality of individual magnetic tumblers.

Prior art magnetic locks of this type have employed a magnetic repulsion force to effect the movement of the tumblers for unlocking the cylinders. In such devices the magnetic tumbler elements and the biasing springs therefore are mounted in the outer lock cylinder for selective engagement and locking with cooperating detents formed in the inner cylinder. When the magnetic key is inserted in the inner cylinder keyway, the tumblers carried in the outer cylinder are magnetically repulsed and thus displaced from the inner cylinder detents to allow rotation of the inner cylinder and key.

Devices of this type have been found very useful and have proven to be satisfactory in most all respects. However, there are some lock applications which require a more positive, reliable magnetic inner action between the coded magnetic key and the individual tumblers. Additionally, in some cases excessive wear occurs in the prior devices which operate on a magnetic repulsion principle, because once the tumblers are repulsed and released from the inner cylinder detents, rotation of the key to open the lock disrupts the magnetic repulsion force and causes the tumblers to be forced under spring bias into abrasive engagement with the inner rotating cylinder. This causes undesirable wear on the outer circumference of the inner cylinder and leads to a shortened useful life of the lock.

Positioning the spring-biased tumblers, including the biasing spring assembly in the outer lock cylinder, also increases the overall size of the lock. In most cases, the tumbler and biasing spring are arranged so as to be radially aligned with the magnetic elements of the key so that the tumblers are repulsed along a radial line with respect to the cylinders. This usual radial alignment requires that the outer locking cylinder have relatively large cross-sectional dimensions at least in the region of the tumblers to accommodate this radial tumbler motion. It would be desirable to provide a more compact lock mechanism, however the nature of the magnetic repulsion used by prior art locks of this type necessitates the larger construction.

Accordingly it is an object of the present invention to provide a magnetic tumbler lock which is an improvement over the existing, prior art magnetic locks and eliminates one or more of the above noted disadvantages thereof. More particularly, it is one object of the present invention to provide a more reliable positive locking and unlocking action by enhancing the magnetic forces which interact between the magnetically coded key and plurality of magnetic tumblers.

Another object of the present invention is to provide a more compact lock construction, in which the overall size of the inner and outer cylinders is reduced.

Still a further object of the present invention is to provide a lock mechanism of the magnetic tumbler type capable of providing improved lock security in terms of the number and orientation of the magnetic elements carried by the key and the sensitivity of the magnetic tumblers thereto.

Additionally, it is an object of the present invention to eliminate the mechanical wear on the tumblers as encountered in prior art devices in which the tumblers are released after rotating the key so as to forcefully engage the rotating inner cylinder under the urging of the spring bias.

In general these objectives are achieved in the present invention by a key operated magnetic tumbler lock construction in which the magnetic tumblers are mounted inside the inner cylinder in side-by-side relation to the keyway therein with the magnetic poles of the tumblers oriented with respect to the magnetic elements of the key so as to cause mutual magnetic attraction therebetween. The tumblers are thus normally urged by biasing springs also carried by the inner cylinder into a protracted condition with respect thereto so as to engage cooperating detents formed in the outer cylinder. Insertion of the magnetically coded key causes the tumblers to be magnetically attracted, under a stronger and more positive magnetic force than available from magnetic repulsion, into a retracted condition relative to the inner cylinder to allow the key and inner cylinder to rotate. This results in a more compact arrangement because the tumblers are mounted in space efficient side-by-side relation with the keyway inside the inner cylinder. Additionally, since the tumblers are displaced by magnetic attraction rather than repulsion, they continue to be held in a retracted or recessed relationship with respect to the outer cylinder detents while the inner cylinder is being rotated by the key to the unlocked position. No mechanical wear is incurred by the tumblers because they are held out of engagement from the inner surface of the outer cylinder during the unlocking rotation.

In one of the embodiments of the invention as disclosed herein, the magnetic attraction between the tumblers and coded key is employed to provide a locking device having enhanced security. Briefly, this is achieved by taking advantage of the fact that each of the tumbler magnets and the associated key magnets tend to be attracted into a stable magnetic relationship in which the magnets are substantially in juxtaposition. This is an automatic positioning principle which is used to selectively position a plurality of double-ended tumblers which are disposed to protrude from either of substantially opposite portions of the inner cylinder to engage opposed detents on the inner wall of the outer cylinder. The double-ended tumbler must be positioned so as not to protrude at either end from the inner cylinder in order to unlock the device, and this positioning is achieved by using the self-seeking alignment of the magnetic attraction forces.

These and further objects, features and advantages of the key operated magnetic tumbler lock in accordance with the present invention will become apparent to those skilled in the art from a consideration of the following detailed description and accompanying drawings of the preferred embodiments of the invention.

BRIEF DESCRIPTION OF THE DRAWINGS

FIG. 3 is a horizontal sectional view of the key and lock of FIG. 1 with the key inserted into the lock keyway.

FIG. 4 is a transverse sectional view taken through the body of the lock as indicated in FIG. 3 by section lines 4—4 with the key being removed.

FIG. 5 is a view similar to FIG. 4 although here showing a different operating mode of the lock with the key inserted in place and the magnetic tumblers withdrawn by magnetic attraction from the outer cylinder detents.

FIG. 6 is a view similar to FIG. 4 of an alternative preferred embodiment of the present invention, again with the magnetically encoded key removed.

FIG. 7 is a view of the same alternative embodiment shown in FIG. 6, however illustrating here the displacement of the tumbler in response to the insertion of the coded magnetic key.

With reference to FIGS. 1 through 5, a coded magnetic key 11 cooperates with a magnetic tumbler lock 12 for selectively locking and unlocking relative rotation between the lock cylinders. In particular, lock 12 includes an outer hollow cylinder 13 best shown in FIG. 2 and an inner cylinder 14 mated to an interior cylindrical wall 16 of outer cylinder 13 for coaxial rotation therebetween.

Figures 1, 2:
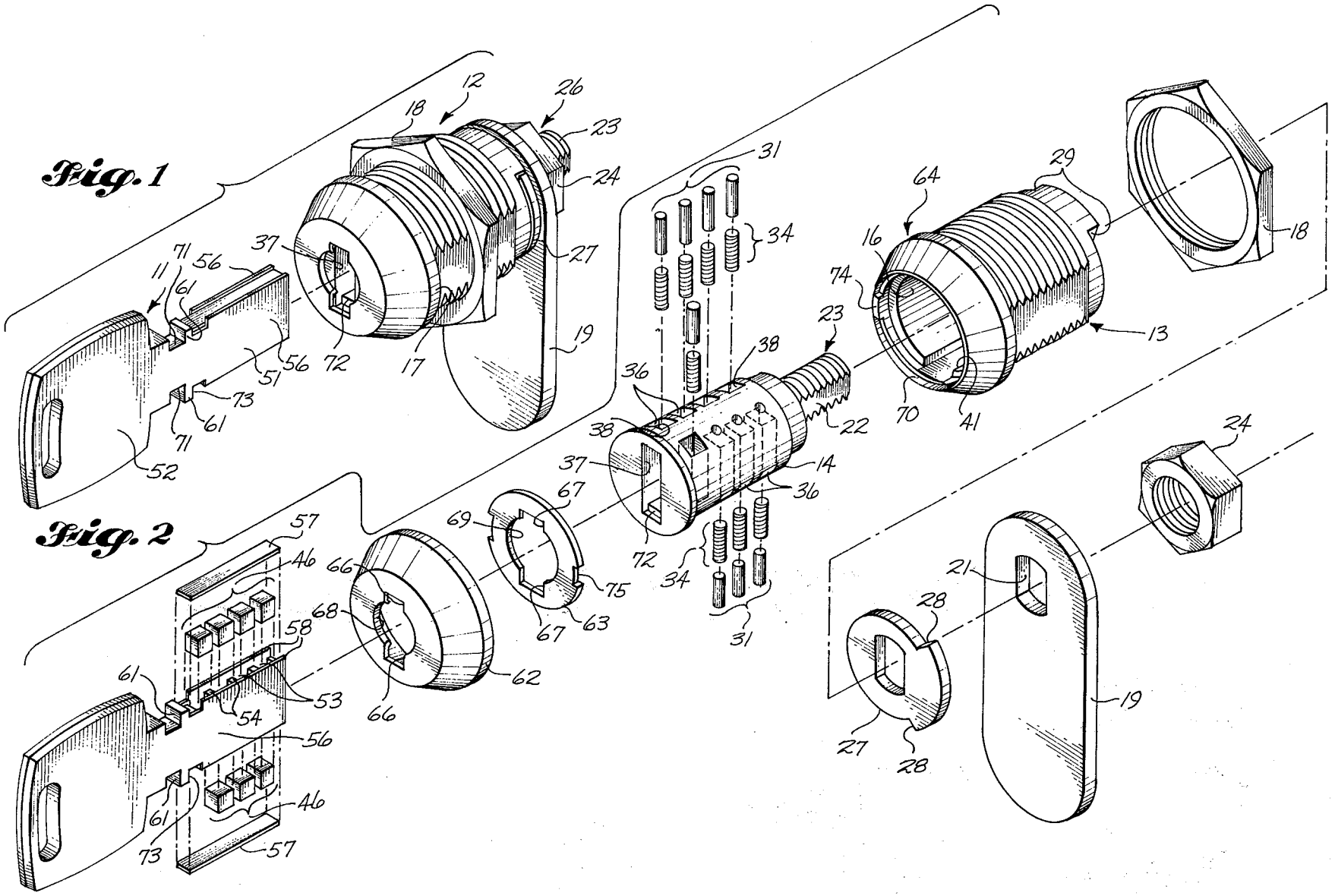
FIG. 1 is an isometric view of the coded magnetic key and cooperating magnetic tumbler lock of the present invention.
FIG. 2 is an exploded isometric assembly view of the key and lock of FIG. 1.

Outer cylinder 13 may be secured to a wall panel or other structure between a circumferential flange 17 and a nut 18 cooperatively threaded to the outer circumference of outer cylinder 13 as shown so that inner cylinder 14 and a cam or locking arm 19 fastened thereto by suitable means may be selectively rotated relative to the mounted outer cylinder. In this instance, arm 19 is provided with a keyed opening 21 mated to correspondingly keyed surfaces 22 of an axially, rearwardly extending threaded stud portion 23 of inner cylinder 14. Arm 19 may be mounted to stud portion 23 of the inner cylinder and secured thereto by a nut fastener 24 as indicated at 26. The rotation of inner cylinder 14 may be limited relative to the outer cylinder 13 by a similarly keyed washer 27 having circumferential stops 28 mounted on said portion 23 inside of arm 19 for engaging complimentary circumferentially disposed stops 29 on outer cylinder 13 as illustrated.

In accordance with the preferred embodiment disclosed herein, coded magnetic, spring-biased tumbler means are mounted substantially inside inner cylinder 14 for cooperating with detent means provided on the interior circumferential surface 16 of outer cylinder 13 for selectively locking and unlocking relative rotation between the cylinders. Here, the spring-biased magnetic tumbler means are provided by a plurality of individual cylindrically shaped tumblers 31 each being formed of a hollow cylindrical nonmagnetic member 32 as best shown in FIGS. 3, 4 and 5 and an inner solid cylindrical magnetic member 33 fixedly mounted inside member 32 for functioning together as a tumbler unit. The spring-biasing is in this instance provided by a plurality of coiled compression springs 34 mounted in axial alignment with tumblers 31 inside tumbler receiving guide means provided in inner cylinder 14. The guide means here are in the form of a plurality of elongated slots or openings 36 extending substantially at right angles to and offset from the axis of the inner cylinder 14 and adjacent an inner cylinder keyway 37 which extends longitudinally of and substantially coincident with the axis of inner cylinder 14.

Elongated openings 36 are each formed in this instance to have an open end 38 at one surface of cylinder 14 and an an abutment 39 distal open end 38 against which one end of compression spring 34 abuts.

The detent means provided on outer cylinder 13 are here formed by detents 41 formed in the interior cylindrical surface 16 of outer cylinder 13 in opposed registration with open ends 38 of the tumbler guide openings 36. One or more longitudinally extending, continuous recesses or grooves may be formed in surface 16 as in this case to define the detents for a plurality of tumblers 31. In this manner the spring-biased tumbler assemblies are mounted for reciprocation between protracted and retracted or flush conditions with each of the tumblers 31 being continuously urged by springs 34 toward the protracted condition as best shown in FIG. 4. In the protracted condition, tumblers 31 are seated in locked engagement with respect to the cooperating outer cylinder detents 41.

In order to unlock tumblers 31 from detents 41, a coded magnetic key means is provided for mated insertion in keyway 37. Here the key means is provided by key 11 carrying a plurality of magnetic members 46 arranged with the magnetic poles thereof oriented with respect to the magnetic poles of the tumbler magnetic members 33 for causing conserted magnetic attraction between the key and tumbler magnetic elements. More particularly, the magnetic attraction between the plurality of individual key magnetic members 46 and the associated plurality of tumbler magnetic members 33 causes tumblers 31 to be withdrawn inwardly to a retracted condition with respect to inner cylinder 14 and more particularly with respect to open ends 38 of guide openings 36 for unlocking relative rotation between the cylinders. This mutual magnetic attraction of the key and tumbler magnetic members is best illustrated in FIG. 5 of the drawings wherein tumblers 31 are withdrawn from detents 41 of the outer cylinder toward and into the retracted condition inside the shearline between outer and inner lock cylinders 13 and 14.

It will be observed that the spring-biased tumbler assemblies are all carried substantially inside the body of the inner cylinder 14 in a compact, space conserving arrangement side-by-side with inner cylinder keyway 37. Using the principal of magnetic attraction as opposed to magnetic repulsion, the magnetic tumblers 31 are positively, firmly withdrawn out of detents 41 to the retracted condition as shown in FIG. 5 and held in such retracted condition during the succeeding rotation of inner cylinder 14 by key 11. There is no tendency for tumblers 31 to rub on the interior surface of outer cylinder 13 nor to catch on the edges formed by detents 41 as the inner cylinder tumblers are rotated out of and into locking registration with the detents.

To achieve the magnetic attraction between the tumbler and key magnetics, the magnetic elements are arranged with the respective magnetic poles disposed so that the opposite poles of the respective magnetic members are mutually attracted and seek an orientation in which the magnetic field lines are substantially closed. That is, with reference to FIG. 5, the south (S) — north (N) poles of tumbler magnetic members 33 are oriented in side-by-side opposition to the north (N) — south (S) poles of magnetic key members 46 such that the magnetic field lines 47 close on one another. This mutual attraction also causes the opposite poles of the respective magnetic members to seek the closest side-by-side proximity that is possible under the constraints imposed by the tumbler guide opening 36. The strongest magnetic inter-action between the tumbler and key magnetic members results when the tumblers 31 are withdrawn from the detents and members 33 assume the above-mentioned alignment with the key magnetic members 46.

Key 11 is provided with an elongate portion 51 mated to keyway 37 and having a plurality of recesses or detents to serve as a means for receiving and retaining key magnetic members 46. In this instance, keyway 37 and portion 51 of key 11 are formed with mated, rectangular cross sections of major and minor dimensions with the major dimensions extending substantially diametrically and longitudinally of inner cylinder 14. With this configuration of keyway 37, tumbler guide openings 36 are disposed to extend along side and parallel to the major dimensions of keyway 37 on one or as in the present embodiment both sides of the keyway. Furthermore, the magnetic members 33 of the various tumblers 31 may be disposed as in the present embodiment with their north-south poles aligned with the axis of movement of the tumbler. Similarly, the north-south poles of the individual magnetics carried by key 11 may be oriented as shown in alignment with the major cross-sectional dimension of keyway 37. With this arrangement, the tumbler magnets are positioned for moving along their polar axes in parallel juxtaposition with the polar axes of the key magnets for achieving the mutual magnetic attraction therebetween for withdrawing the tumblers from the outer cylinder detent 41.

Key 11 may be a relatively flat configuration having an enlarged keyhead portion 52 coplanar with elongate portion 51. Elongate portion 51 may be constructed to receive and retain the individual magnetic key members 46 as shown by the provision of a plurality of magnet member receiving slots or recesses 53 defining longitudinal spacers 54 for separating members 46, all of which are formed in one or both of the minor longitudinal faces of elongate portion 51 as best shown in FIG. 2. The major faces 56 of portion 51 may be extended beyond magnetic spaces 54 as extensions 58 for accommodating retaining strips 57 where wall extensions 58 may be peened inwardly and over retaining strips 57 for securing magnetic members 46 in place as shown in FIG. 1.

Additionally, key 11 may be provided with opposed teeth 61 here in the plane of elongate portion 51 and head portion 52 for cooperating with abutments formed adjacent the entry of keyway 37 as it is shown in FIG. 1 to insure the proper orientation and depth of insertion of key 11 relative to tumblers 31. In particular, a front thin wall shield 62 and correspondingly shaped structural protection member 63 are attached to a circumferentially and forwardly tapered flange 64 of outer cylinder 13 and formed with transverse keyway openings 66 and 67 aligned with keyway 37 and being substantially coterminous with the major cross-sectional dimensions thereof. Member 63 seats within an inner circumferential recess 70 of flange 64 and is oriented in rotation by bosses 74 on recess 70 and cutouts 75 on member 63 as shown.

Shield 62 and structural member 63 are also provided with axially aligned annular openings 68 and 69 for accommodating the rotation of key 11 in cooperation with grooved portions 71 formed on the body of key 11 between teeth 61 and head portion 52 as illustrated. Slotted openings 66 and 67 are slightly axially offset relative to the axis of the keyway to cooperate with a corresponding offset in the placement of teeth 61 on key 11. This insures that the key 11 can only be inserted fully into the lock assembly only if the proper vertical orientation of the key is presented to keyway 37. This insures that the coded magnetic members 46 are properly disposed relative to the associated coded tumblers 31 carried by cylinder 14. Also, to insure the proper longitudinal registration of the coded key magnets with the coded tumblers, a keyway abutment 72 limits the inward insertion of elongate portion 51 of key 11 by engaging a forward face 73 of one of teeth 61.

To permit strong magnetic interaction between the key magnets and tumbler magnets, the lock structure in the vicinity of these elements are formed of nonmagnetic metals. A number of metals are available for this purpose. In this particular embodiment a ZnAdc-1 alloy has been used for outer and inner cylinders 13 and 14 and key 11. The magnetic members themselves, namely magnetic tumbler members 33 and key magnetic members 46 are formed of a permanently magnetizable material.

With reference to FIGS. 6 and 7, an alternative embodiment of the present invention is illustrated in which the individual spring-biased tumblers are mounted and operative in the inner cylinder for locking engagement with detents located on opposed interior surfaces of the outer cylinder. In this embodiment the tumblers must be precisely positioned by the coded magnetic key such that the opposed ends of the elongate tumbler are substantially flush with the inner and outer cylinder interface or shearline. Using primed reference numerals to designate corresponding unprimed numbered components of the foregoing figures, FIGS. 6 and 7 show inner and outer relatively rotatable lock cylinders 14' and 13'. As shown in FIG. 6 which is similar to FIG. 4 of the earlier embodiment, inner cylinder 14' is provided with a plurality of elongate slots or openings 81 serving as means for guiding the tumblers and being disposed to extend transversely through the inner cylinder to define open ends 82 and 83 on substantially opposed surfaces of the cylinder 14'. Mounted for slidable axial reciprocation within each of openings 81 is a spring-biased magnetic tumbler 84 of elongate configuration. A longitudinal dimension of tumbler 84 is selected so that when properly centered as shown in FIG. 7 it is coextensive with the opening 81 through the inner cylinder. That is, the opposed axial ends 86 and 87 of each of tumblers 84 are coterminous with tumbler opening 81 when the tumbler 84 is longitudinally centered.

Outer cylinder 13' is provided on its interior circumferential wall 16' with registering, opposed detents 88 and 89 for selectively receiving either of the opposed axial ends 86 and 87 of tumbler 84 in seated locking engagement therewith. In other words, tumbler 84 is bidirectionally displacable within guide opening 81 to lock with either of the opposed detents 88 and 89 and is capable of assuming an unlocked condition only when the tumbler 84 is longitudinally centered with respect to opening 81.

Spring-biased means are provided for tumbler 84 within inner cylinder 14' for continuously urging one of the opposed axial ends toward and into seated engagement with one of the registering detents 88 and 89. In this instance, a biasing spring 91 may be mounted in longitudinal juxtaposition with tumbler 84 as shown in FIGS. 6 and 7 between a laterally extending foot 92 disposed substantially midway on tumbler 84 and an abutment 93 defined by inner cylinder 14' adjacent opening 81. Abutment 93 may be formed at one end of a spring receiving and retaining slot 94 in juxtaposition to guide opening 81 but of lesser dimension along the axis of the cylinders and longitudinally terminating in abutment wall 93 for retaining spring 91 in compression between foot 92 and abutment 93.

This means for biasing tumbler 84 causes end 86 thereof to be urged upwardly in this instance into seated engagement with detent 88 of outer cylinder 13.

In order to release the tumblers from the opposed registering detents, it is necessary to selectively displace the various tumblers so that there ends are substantially flush with the outer circumference of inner cylinder 14'. This is achieved in accordance with the present invention by using the principle that magnetic members, when placed in juxtaposition with their poles extending north-south and south-north, tend to seek a relationship of alignment in which the south pole of one magnetic is aligned with the north pole of the other magnetic and vice versa. It will be observed in connection with FIGS. 6 and 7, that the magnetic members 96 of key 11' may be selectively positioned in elevation as shown in the figure to cause tumblers 84 and the associated magnetic members 97 thereof to withdraw the tumbler by magnetic attraction to its longitudinally centered position as shown in FIG. 7. This moves the tumblers to a position with their opposed axial ends substantially flush with or retracted from the confronting cylindrical surfaces of inner and outer cylinders 14' and 13' to allow relative rotation therebetween.

It will thus be observed that the embodiment of FIGS. 6 and 7 using the mutual magnetic attraction between the tumbler magnets and key magnets, affords a lock having a greater number of permutations in the magnetic coding. For example, the tumbler magnetics 97 may be disposed at any one of an infinite number of different elevations on tumbler 84. In order to properly displace such tumbler so that both axial ends of the tumbler are retracted or flush with respect to the outer circumference of inner cylinder 14', key 11' must be provided with an associated magnetic member 96 properly disposed along the major cross section dimension of the key.

Unless the associated key magnet is thus properly positioned, the magnetic attraction between the tumbler and key magnets may cause excessive displacement of the tumbler against the biasing force of spring 91 forcing axial end 87 to lock with detent 89, or a weaker magnetic attraction or repulsion may cause axial end 86 of the tumbler to be retained in seated locking engagement with detent 88. By reason of the greater number of permutations afforded by the embodiment of the invention shown in FIGS. 6 and 7 and because the tumbler elements in this embodiment are more sensitive to the magnetic interaction between the key magnets and tumbler magnets, this lock construction provides when needed for greater security.

While only a limited number of particular embodiments of the present invention have been disclosed herein, it will be readily apparent to persons skilled in the art that numerous changes and modifications may be made thereto without departing from the spirit of the invention. For example, although the foregoing embodiments illustrate the poles of the various key and tumbler magnetics as extending along axial lines which are spaced apart and parallel other polar orientations may be employed. For example, the magnetic poles may be oriented with their axes extending at right angles while still achieving the desired mutual magnetic attraction therebetween.

Accordingly, the foregoing disclosure and description thereof are for illustrative purposes only and do not in any way limit the invention which is defined only by the following claims.

What is claimed is:

1. In a key operated magnetic tumbler lock of the type including an outer hollow cylinder, an inner cylinder mated for coaxial relative rotation inside said outer cylinder and having an elongate keyway extending substantially parallel to the axis of said inner cylinder, a plurality of magnetic tumbler assemblies carried in said inner cylinder and a corresponding plurality of cooperating detents provided on an inner surface of said outer cylinder for selectively locking and unlocking said relative rotation therebetween, and a key carrying a plurality of magnetic members for insertion in said keyway for magnetically causing the disengagement of said associated magnetic tumbler assemblies and cooperating detents to unlock said cylinders, the improvement comprising:

elongate tumbler receiving guides disposed in said inner cylinder and extended transversely to and in juxtaposition with said keyway;

said magnetic tumbler assemblies each including a magnetic tumbler and biasing spring mounted in individual ones of said tumbler guides for longitudinal slideable reciprocation of said tumblers between a protracted condition engaging said detents and a retracted condition juxtaposed said keyway, said biasing springs continuously urging said tumblers toward said protracted condition, said magnetic tumblers each defining a magnetic polar axis and being disposed with said polar axes substantially longitudinally aligned with the longitudinal dimension of said guides;

said detents being provided on an inner surface of said outer hollow cylinder in cooperating registration with said tumblers in their protracted condition for locking said relative rotation of said cylinders; and said members of said key each defining a magnetic polar axis and being oriented such that when said key has been inserted in said keyway said members are disposed with their polar axes in substantial parallel juxtaposition and in polar opposition to the polar axes of said tumblers to slideably withdraw said tumblers to said retracted condition.

2. The improved key operated magnetic tumbler lock of claim 1, wherein said inner cylinder has a plurality of elongate slots formed therein to provide said guides, the longitudinal dimension of said slots extending substantially at right angles to the axis of said inner cylinder adjacent said keyway.

3. The improved key operated magnetic tumbler lock of claim 1, wherein said keyway extends substantially centrally of said inner cylinder and said inner cylinder has a plurality of elongate slots extending substantially transversely to and offset from the axis of said inner cylinder adjacent said keyway to provide said tumbler guides, each said slot opening at one end at an exterior surface of said inner cylinder for receiving a tumbler assembly and having an abutment formed at an opposite end for retaining said biasing spring in compression between said abutment and said magnetic tumbler, whereby said biasing springs of said tumbler assemblies continuously urge associated said tumblers to said protracted conditions for engaging said outer detents.

4. The improved key operated magnetic tumbler lock of claim 1, wherein said magnetic members of said key and said magnetic tumblers of said tumbler assemblies are arranged such that when said key has been inserted in said keyway and said magnetic tumblers have assumed said retracted condition the magnetic poles of associated said magnetic tumblers and magnetic members produce magnetic field lines that substantially close on each other.

5. The improved key operated magnetic tumbler lock of claim 1, wherein said keyway defines a transverse substantially rectangular cross section of major and minor dimensions with said major dimension extending substantially diametrically of said inner cylinder, said inner cylinder having a plurality of elongate slots providing said tumbler guides, each of said slots extending substantially at right angles to the axis of said inner cylinder and in juxtaposition with at least one of the major dimension sides of said keyway, said magnetic tumblers of said tumbler assemblies being longitudinally, slideably disposed in said elongate slots.

6. The improved key operated magnetic tumbler lock of claim 1, wherein:

said tumbler receiving guides comprise a plurality of elongate slots extending substantially transversely through said inner cylinder to define slot openings on substantially opposed exterior surfaces of said inner cylinder;

said magnetic tumblers being elongate and slideably mounted in said slots for bidirectional reciprocation therein between a retracted condition in which opposed axial ends of said tumblers are substantially flush with the exterior surface of said inner cylinder and alternate protracted conditions in which one and then the other of the axial ends of said tumblers protrudes from said inner cylinder surface;

means mounting said biasing springs in said guide means for continuously urging said tumblers to said protracted condition with one of the axial ends thereof protruding from said inner cylinder exterior surface for cooperating with said detents;

additional detents provided on said inner surface of said outer cylinder opposed to said first named detents and cooperating with the other axial ends of said tumblers; and said magnetic tumblers each having a magnetic member mounted along the length thereof and oriented with the magnetic poles thereof causing mutual attraction between an associated magnetic member of said key, said associated tumbler and key magnetic member being selectively positioned relative to one another to cause said elongate tumblers to slideably assume said retracted condition as said magnetic tumbler self aligns itself by magnetic attraction with the associated key magnetic member.

7. The improved key operated magnetic tumbler lock of claim 6, wherein said keyway defines a transverse substantially rectangular cross section of major and minor dimensions with said major dimension extending substantially diametrically of said inner cylinder, said elongate slots disposed substantially parallel to and in juxtaposition with at least one of the major dimension sides of said keyway.

8. The improved key operated magnetic tumbler lock of claim 7, wherein said biasing springs are elongate compression springs and said means mounting said springs include an elongate spring receiving slot longitudinally juxtaposed each of said guide slots and of lesser longitudinal dimension than said guide slots, each said spring receiving slots terminating at one end in an abutment, each said tumbler having a lateral foot disposed intermediate the ends thereof, and said biasing springs being mounted in said spring receiving slots longitudinally juxtaposed to said guide slots and in compression between said abutment and foot to urge one axial end of said tumblers toward said protracted condition.

9. A key operated magnetic tumbler lock comprising:

inner and outer relatively rotatable coaxially disposed cylinder means;

coded magnetic tumbler means slideably mounted in tumbler receiving openings provided in said inner cylinder means, each said tumbler means having magnetic poles defining a polar axis;

detent means provided on said outer cylinder means for cooperating with said tumbler means for selectively locking and unlocking said relative rotation between said cylinder means;

keyway means provided in said inner cylinder means in juxtaposition with said tumbler receiving openings; and coded magnetic key means mated for insertion in said keyway means and having magnetic means defining a plurality of polar axes oriented such that when said key means has been inserted in said keyway means said polar axes of said key means are disposed in parallel juxtaposition and in polar opposition with said polar axes of said tumbler means for causing conserted magnetic attraction between said coded key means and said tumbler means to slide said tumbler means into juxtaposition with said magnetic means of said key means, whereby said tumbler means are withdrawn from said detent means to unlock said inner and outer cylinder means for allowing relative rotation therebetween.

* * * * *